US006628903B1

(12) United States Patent
Ohori et al.

(10) Patent No.: US 6,628,903 B1
(45) Date of Patent: Sep. 30, 2003

(54) IMAGE FORMING APPARATUS HAVING A SENSOR FOR SENSING AN AMOUNT OF REFLECTED LIGHT FROM BOTH A PHOTOCONDUCTIVE ELEMENT AND A PAPER

(75) Inventors: Mayumi Ohori, Kawasaki (JP); Masaru Tanaka, Yokohama (JP); Haruji Mizuishi, Tokyo (JP); Hiroyuki Ohkaji, Yokohama (JP); Kenzo Tatsumi, Yokohama (JP); Hiroshi Mizusawa, Tokyo (JP); Ken Amemiya, Tokyo (JP); Hideki Zenba, Yokohama (JP); Fumio Kishi, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 512 days.

(21) Appl. No.: 09/627,323

(22) Filed: Jul. 27, 2000

Related U.S. Application Data

(62) Division of application No. 09/241,856, filed on Feb. 2, 1999, now Pat. No. 6,144,811.

(30) Foreign Application Priority Data

Feb. 2, 1998 (JP) ..... 10-36725
Dec. 8, 1998 (JP) ..... 98-6812

(51) Int. Cl.[7] ..... G03G 15/00
(52) U.S. Cl. ..... 399/21; 399/48; 399/49
(58) Field of Search ..... 399/9, 18, 21, 399/22, 48, 49, 72, 64

(56) References Cited

U.S. PATENT DOCUMENTS 5,019,856 A * 5/1991 Ohashi et al. ..... 399/18
5,406,354 A * 4/1995 Taki et al. ..... 399/22
5,860,038 A 1/1999 Kato et al. ..... 399/49

FOREIGN PATENT DOCUMENTS

JP 9-319224 12/1997

* cited by examiner

*Primary Examiner*—Hoan Tran
(74) *Attorney, Agent, or Firm*—Oblon, Spivak, McClelland, Maier & Neustadt, P.C.

(57) ABSTRACT

An image forming apparatus with a sensing control system having an optical sensor and a control device. A detected object is recognized by using the difference of an output characteristics correspond to a quantity of reflected light. Thus, one or more detected objects may be precisely detected by the one optical sensor.

3 Claims, 9 Drawing Sheets

| | OUTPUT CHARACTERISTIC (OUTPUT VOLTAGE) |
|---|---|
| $V_{SG}$ | 4.0 V |
| $V_P$ | 3.0 V |
| $V_{S1}$ | 0.5 V |

FIG. 4

IMAGE FORMING APPARATUS HAVING A SENSOR FOR SENSING AN AMOUNT OF REFLECTED LIGHT FROM BOTH A PHOTOCONDUCTIVE ELEMENT AND A PAPER

This application is a Division of application Ser. No. 09/241,856 Filed on Feb. 2, 1999 now U.S. Pat. No. 6,144,811.

BACKGROUND OF THE INVENTION

1. Field of the Invention

The present invention relates to an image forming apparatus including a sensing control system.

2. Discussion of the Background

In recent years, based on the increasing demand for smaller and less expensive configurations, various image forming apparatuses (e.g., copying machines, printers. facsimile machines and multi-function machines) having copying, facsimile and printer functions, have been designed. Accordingly, many of the individual parts, including the sensors, must be made smaller and less expensively. Generally, image forming apparatuses are provided with various kinds of the sensors. In particular, various sensors (e.g., density sensors) are provided around an image carrier, and various sensors (e.g. jam sensors) are provided along a recording medium path.

Japanese Laid-Open Patent Publication No. 6-186801 discloses a reflection type photosensor rotatably supported in the vicinity of (1) a photosensitive device and (2) a transfer belt so that a detecting direction can be varied between the photosensitive device side and the transfer belt side. However, that configuration uses a large space between the photosensitive body and the transfer belt to turn the photosensor and utilizes many parts to mount the photosensor rotatable.

Japanese Laid-Open Patent Publication No. 5-2302 discloses an image forming apparatus having a sensor (21 and 22) fixed inside a transfer means 16. Thus, the optical path of the sensor when sensing a toner pattern on the image carrier 4 and a recording medium is optically "obstructed" by the transfer means. Moreover, the transparency (or amount of obstruction) of the transfer means changes over time due to scratches from friction between the transfer means and the recording medium supported on the transfer means. Thus, a detection error may occur in the sensor because of a change in a quantity of reflected light of the sensor.

SUMMARY OF THE INVENTION

It is an object of the present invention to address deficiencies in such known systems.

It is another object of the present invention to provide an image forming apparatus having (1) stable toner density sensing, (2) recording medium detection, (3) control of a process for forming visible toner, (4) recording medium conveying control, and (5) a miniature and inexpensive configuration.

These and other objects of the present invention are achieved by a sensor with a single unobstructed optical path for sensing (1) a toner pattern on a photoconductive element and (2) a presence/absence of a recording medium.

BRIEF DESCRIPTION OF THE DRAWINGS

Many of the features and advantages of the present invention will become more apparent from the following detailed discussion when read in conjunction with the accompanying drawings in which:

FIG. 4 is a table of voltage values for an optical sensor:

DESCRIPTION OF THE PREFERRED EMBODIMENTS

Figure 1A:
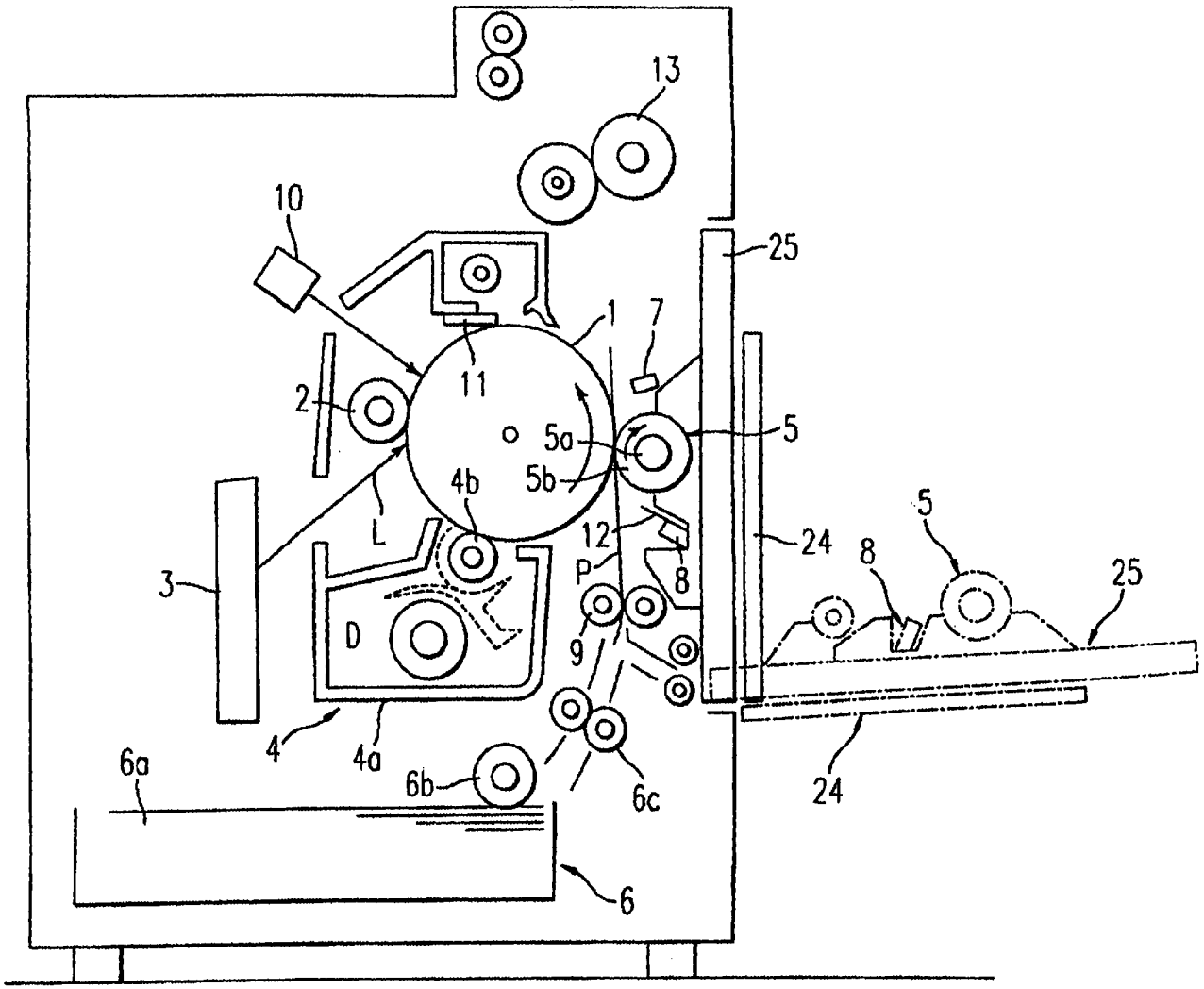
FIG. 1A is a schematic illustration showing an image forming apparatus according to a first embodiment of the present invention.

The present invention is explained in detail hereinafter using like reference numerals for identical or corresponding parts, throughout the several views, in which FIG. 1 is a schematic illustration of an image forming apparatus according to one embodiment of the present invention. As shown, the image forming apparatus 100 includes a photoconductive element or rotating image carrying element (e.g., a drum 1, a belt, or an intermediate transfer element). A charge roller 2 charges the surface of the drum 1. A writing device 3 forms an electrostatic latent image on the drum 1. A developing device 4 develops the electrostatic latent image by transferring toner to the drum 1. A transfer device (e.g. a contact type transfer roller 5, a belt, a brush, or a blade) transfers a developed image onto a sheet of paper P fed by a sheet feeding device 6. A sensing control system is provided with an optical sensor 8 and senses a toner density and detects a transfer sheet P. A control device 17, which will be described later, is also included in the image forming apparatus.

When the image forming apparatus 100 is activated, a drive motor, not shown, causes the drum 1 to rotate, as in the direction shown in FIG. 1, thereby rotating the charge roller in contact with the surface of the drum 1. During rotation, a voltage of preselected polarity is applied to the charge roller 2. As a result, the surface of the drum 1 is charged to a preselected polarity, e.g., to a negative polarity in the illustrative embodiment. For example, the surface potential of the drum 1 may be −800 V.

The writing device 3 uses a laser beam L to scan the charged surface of the drum 1, thereby forming an electrostatic latent image in accordance with image data. The potential of the surface portion of the drum 1 that is scanned by the laser beam L is lowered (e.g., to −100 V). This creates the latent image. The portion of drum 1 not scanned by the laser beam L acts as a background and maintains a potential of about −800 V.

As the drum 1 rotates, the developing device 4 coats a portion of the drum 1 with toner to form a toner image. Thus, a corresponding toner image is formed as a visible image on the drum 1. In the illustrative embodiment, the developing device 4 includes a casino 4*a* storing developer D with a two-ingredients—i.e. the toner and the developer which are charged to opposite polarities due to friction. In the illustrative embodiment, the toner is charged to a negative polarity and the carrier is charged to a positive polarity. A developing roller 4*b* is disposed in and rotatably supported by the casing 4*a*. When the developing roller 4*b*, housing a magnet (not shown is rotated, the developer D is magnetically deposited on the surface of the roller 4*b* and conveyed thereby to a developing area between the roller 4*b* and the drum 1.

A preselected bias voltage. (e.g. −600 V in the illustrative embodiment) is applied to the developing roller 4*b*. As a result, the toner of the developer D is electrostatically transferred from the developing roller 4*b* to the latent image carried on the drum 1 due to a difference between the surface potential of the latent image and the potential of the roller 4*b*. That is, an image forming potential of 500 V is created between the −100 V latent image on the drum 1 and the −600 V on the roller. The latent image, therefore, turns into a toner image. In the illustrative embodiment, the image carrier is implemented by a negatively chargeable organic photoconductor while a two-ingredient developer including negatively chargeable toner implements the developer.

A sheet feeding device 6 is provided with (1) a cassette 6*a*, (2) a feeding roller 6*b* which is capable of individually transferring, one by one, transfer sheets P contained the cassette 6*a*, and (3) a pair of conveying rollers 6c facing each other at the positions across a conveying path of the transfer sheet P. A pair of registration rollers 9 controls when the transfer sheet P is fed to a transfer area in which the photoconductive drum 1 and the transfer roller 5 contact each other.

The transfer sheet P sent out from the cassette 6*a* is conveyed to a registration position R by the conveying roller 6*c*. From there the feeding timing for moving the transfer sheet to the transfer area is controlled by the pair of registration rollers 9.

The transfer roller 5 has a shaft 5*a* formed of an electrically conductive material (e.g. metal) and an elastic surface layer 5*b* (e.g. made of a sponge rubber or a foam rubber such as an urethane foam). The transfer roller 5 is held in contact with the drum 1 under a preselected pressure and moved in the opposite direction as the drum 1, as seen at the position where the transfer roller 5 and drum 1 contact each other. When the transfer sheet P passes through the transfer area between the transfer roller 5 and the drum 1, a voltage opposite in polarity to the charge of the toner forming the toner image on the drum 1. (i.e., a positive voltage in the illustrative embodiment) is applied to the transfer roller 5. Under this condition, an electric field is formed between the drum 1 and the transfer roller 5. This causes the toner to be transferred from the drum 1 to the transfer sheet P. The transfer sheet P with the toner image is separated from the drum 1 by a separating device 7.

The transfer sheet P separated from the drum 1 is conveyed to a fixing device 13, and the toner image is fixed on the transfer sheet P with heat and pressure. Finally, the transfer sheet P is driven out of the apparatus 100. A cleaning member 11 removes the toner left on the drum 1 after the above image transfer. A discharge lamp 10 illuminates the cleaned surface of the drum 1 in order to lower its potential to a reference value.

As the above image forming operation is repeated, the toner of the developer D stored in the casing 4*a* is consumed. As a particular toner pattern forms a particular visible image on the drum 1, the optical sensor 8 senses the density of the toner pattern. When the density of the toner pattern is determined to be low, toner is replenished into the developer D of developing device 4. The particular toner pattern may be formed in various locations, including before and after the toner image on the drum 1 or at a particular timing not obstructing the formation of the toner image.

Moreover, the optical sensor 8 detects the presence or absence of the transfer sheet P in the transfer area or in an area near the transfer area. Thus, a control device 17 operates as a control means in conjunction With an optical sensor 8 to detect an abnormality in the transfer of the transfer sheet P. More specifically, a jam is regarded as having occurred prior to the optical sensor 8 if the transfer sheet P remains undetected by the optical sensor 8 for more than a preset time after starting the pair of registration rollers 9. Likewise, a jam is detected after the sensor mounting position when the transfer sheet P takes longer to pass the optical sensor 8 than a reference time.

As shown in FIG. 1A, the optical sensor 8 is positioned downstream from the developing device 4, but upstream from the transfer roller 5, in the direction of rotation of the drum 1. The sensor 8 is (1) close enough to the path of the transfer sheet P to accurately detect voltages and patterns on the drum and sheets and (2) far enough away from the transfer path to avoid jams. Such a distance is in the range of 16–24 mm and is preferably is spaced 20 mm from the surface of the drum 1. Sensor 8 is mounted so that it is optically unobstructed, i.e., optically unobstructed by any components, within the image forming device that are subject to wear or damage due to ordinary use. Optically unobstructed is used herein to refer to obstructions outside of the sensor since the sensor itself clearly may contain a lens or other focusing or protection element. Unlike the LED 21 and photodiode 22 of JP 5-2302 which are housed inside a transfer means 16 and are subject to being scratched, the optical path of the sensor 8 of the present invention is unobstructed by elements that are subject to wear (e.g., subject to scratches) on a side cover plate 25 that is rotatably arranged on the image forming apparatus 100. The side cover plate also engages the transfer roller 5 and provides support for the blocking member 12, the registration rollers 9, and the manual sheet-feeding table 24. When a jam occurs in the transfer area, the side cover plate 25 opens to allow access to the jammed sheet.

Figure 1B:
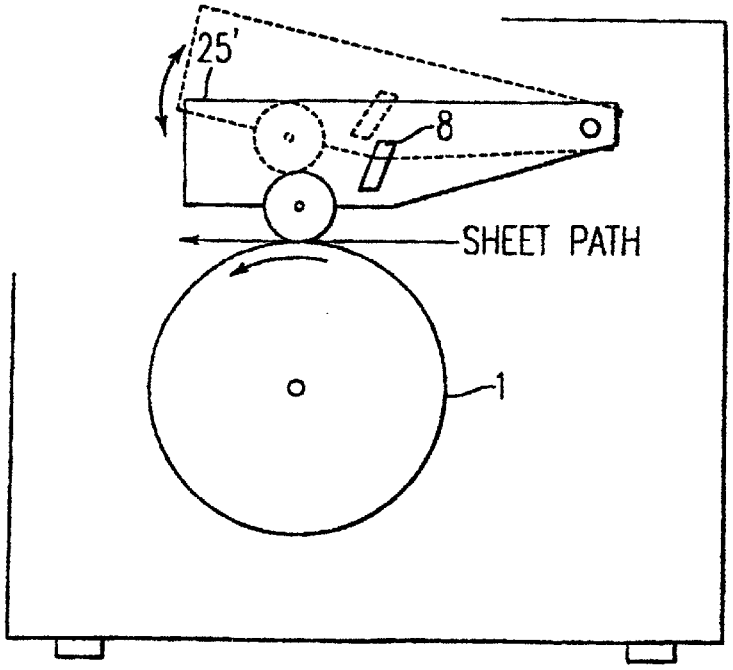
FIG. 1B is a schematic illustration showing an image forming apparatus according to a second embodiment of the present invention.

FIG. 1B is a schematic illustration of a second embodiment of the image forming device according to the present invention. The side mounted cover plate 25 (shown in FIG. 1A) is replaced by a top mounted cover plate 25' that rotates to allow access to the sheet path for removing jammed paper. The sensor 8 is mounted to provide an unobstructed optical path from or through the bottom portion of the top mounted cover plate 25'. The sensor 8 is preferably mounted in the middle (in an into the page versus out of the page direction) of the top cover plate 25', but may be placed at any location on that provides an unobstructed optical path to both the photoconductive element and the sheet path. As with alternatives to the first embodiment, in an alternative embodiment based on the second embodiment, multiple sensors 8 can be mounted on the top mounted cover plate 25' so that each of the multiple sensors senses at least one of the photoconductive element and the recording medium.

Figure 1C:
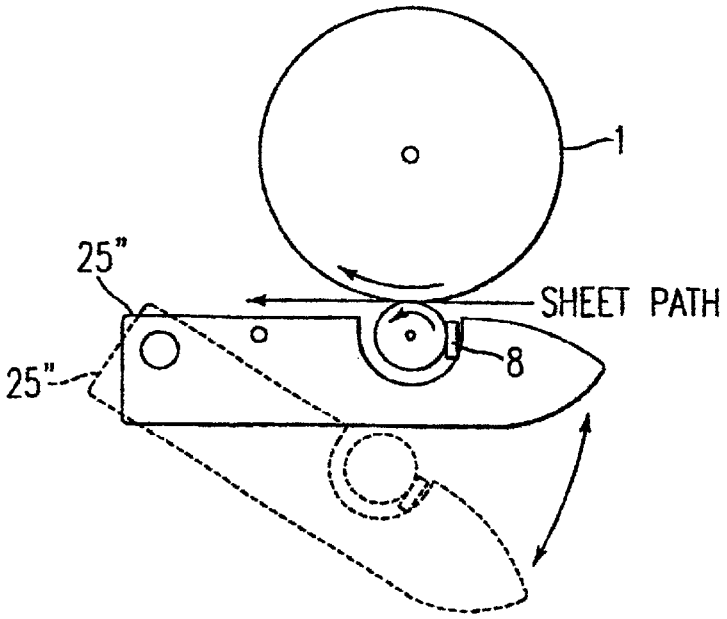
FIG. 1C is a schematic illustration showing an image forming apparatus according to a third embodiment of the present invention.

FIG. 1C is a schematic illustration of a third embodiment of the image forming device according to the present invention. The side mounted cover plate 25 (shown in FIG. 1A) and the top mounted cover plate 25' are replaced by a bottom mounted cover plate 25" that rotates to allow access to the sheet path for removing jammed paper. The sensor 8 is mounted to provide an unobstructed optical path from or through the top portion of the bottom mounted cover plate 25". The sensor 8 is preferably mounted in the middle (in an into the page versus out of the page direction) of the bottom cover plate 25", but may be placed at any location on that provides an unobstructed optical path to both the photoconductive element and the sheet path. As with alternatives to the first and second embodiments, in an alternative embodiment based on the third embodiment, multiple sensors 8 can be mounted on the bottom mounted cover plate 5" so that each of the multiple sensors senses at least one of the photoconductive element and the recording medium. As is discussed below in greater detail, in alternate embodiments based on any of the first through third three embodiments, the sensor 8 is fitted with a blocking member for preventing debris from collecting on the sensor 8.

Figure 2:
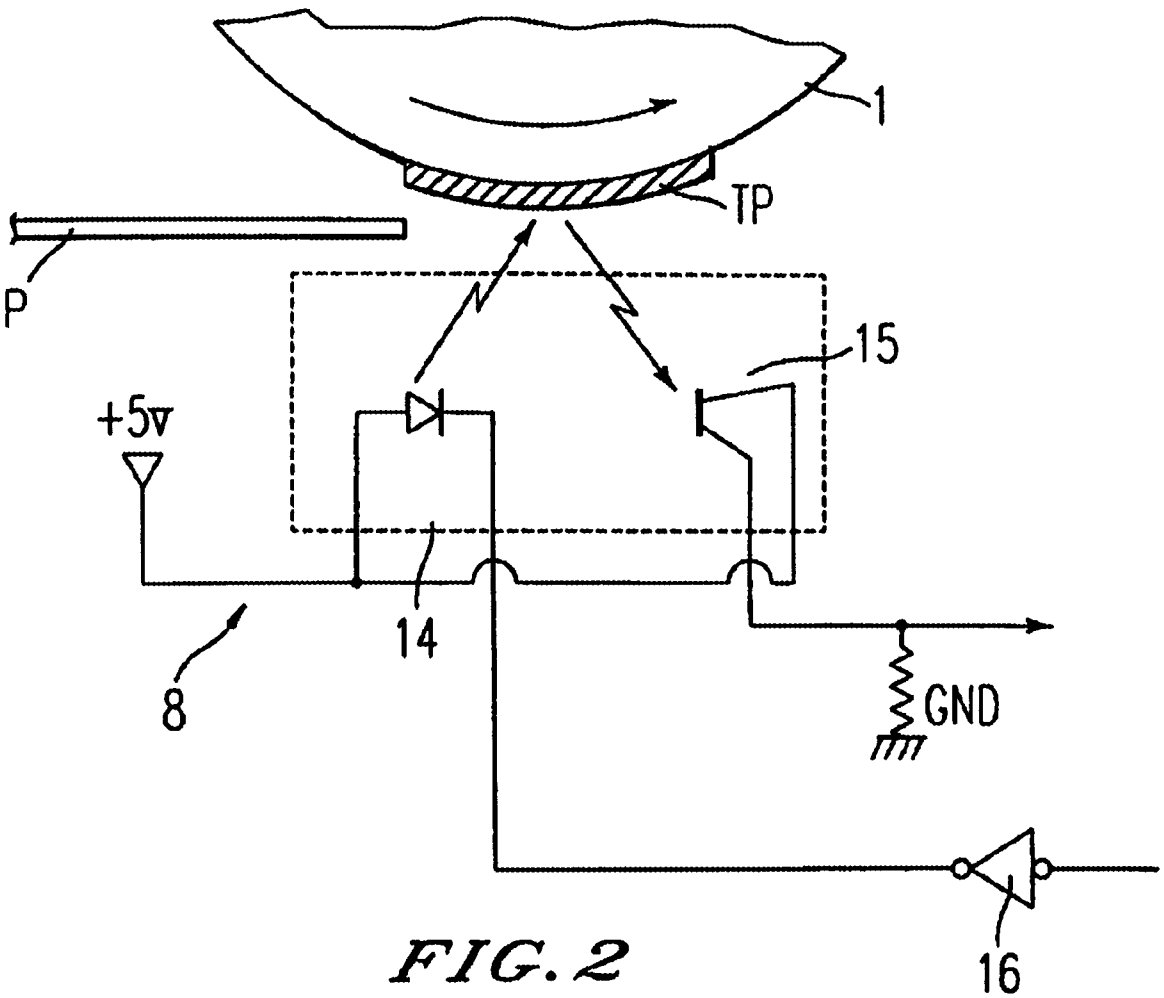
FIG. 2 is a schematic illustration showing one embodiment of an optical sensor.

FIG. 2 shows a specific configuration of the optical sensor 8. As shown, the sensor 8 includes a light emitting device 14 (e.g., an LED (Light Emitting Diode)), a light sensitive device 15 (e.g., a phototransistor), and a controller 16 for turning the light emitting device 14 on and off. The controller 16 causes the light emitting device 14 to emit light while the toner pattern, labeled TP, on the drum 1 or the transfer sheet P passes through a position where it faces the sensor 8. The resulting reflected light from the toner pattern or the transfer sheet P is incident to the light sensitive device 15. The light sensitive device 15 therefore outputs a voltage (or a current) representative of the quantity of reflected light. This voltage is sent to an analog-to-digital converter (ADC) included in or connected to a CPU (Central Processing Unit) which forms part of the control device 17 (see FIG. 3). In an alternate embodiment of the present invention, the CPU of the control device is replaced with any one of (1) an application specific integrated circuit, (2) a reprogrammable integrated circuit (e.g., an FPGA or a GAL), and (3) a one-time programmable integrated circuit, any of which can read from (or internally incorporate) the non-volatile memory described below. As a result, the density of the toner pattern or the presence or absence of the transfer sheet P is determined. Together, the optical sensor 8 and control device 17 form a sensing means.

As stated above, the system includes at least one computer readable, non-volatile memory or medium. Examples of computer readable memory media are compact discs 119, hard disks 112, floppy disks, tape, magneto-optical disks, PROMs (EPROM, EEPROM, and Flash EPROM), etc. Stored on any one or on a combination of computer readable media, the present invention includes software for controlling both the hardware of the image forming device and software for allowing the image forming device to interact with a human user. Such software may include, but is not limited to, device drivers, operating systems and user applications. Such computer readable media further includes the computer program product of the present invention for controlling image forming according to a set of sensor readings from a sensor. The computer code devices of the present invention can be any interpreted or executable code mechanism, including but not limited to scripts, interpreters, dynamic link libraries, Java classes, and complete executable programs. The computer readable medium also includes a transmission line for receiving software or firmware upgrades.

Figure 3:
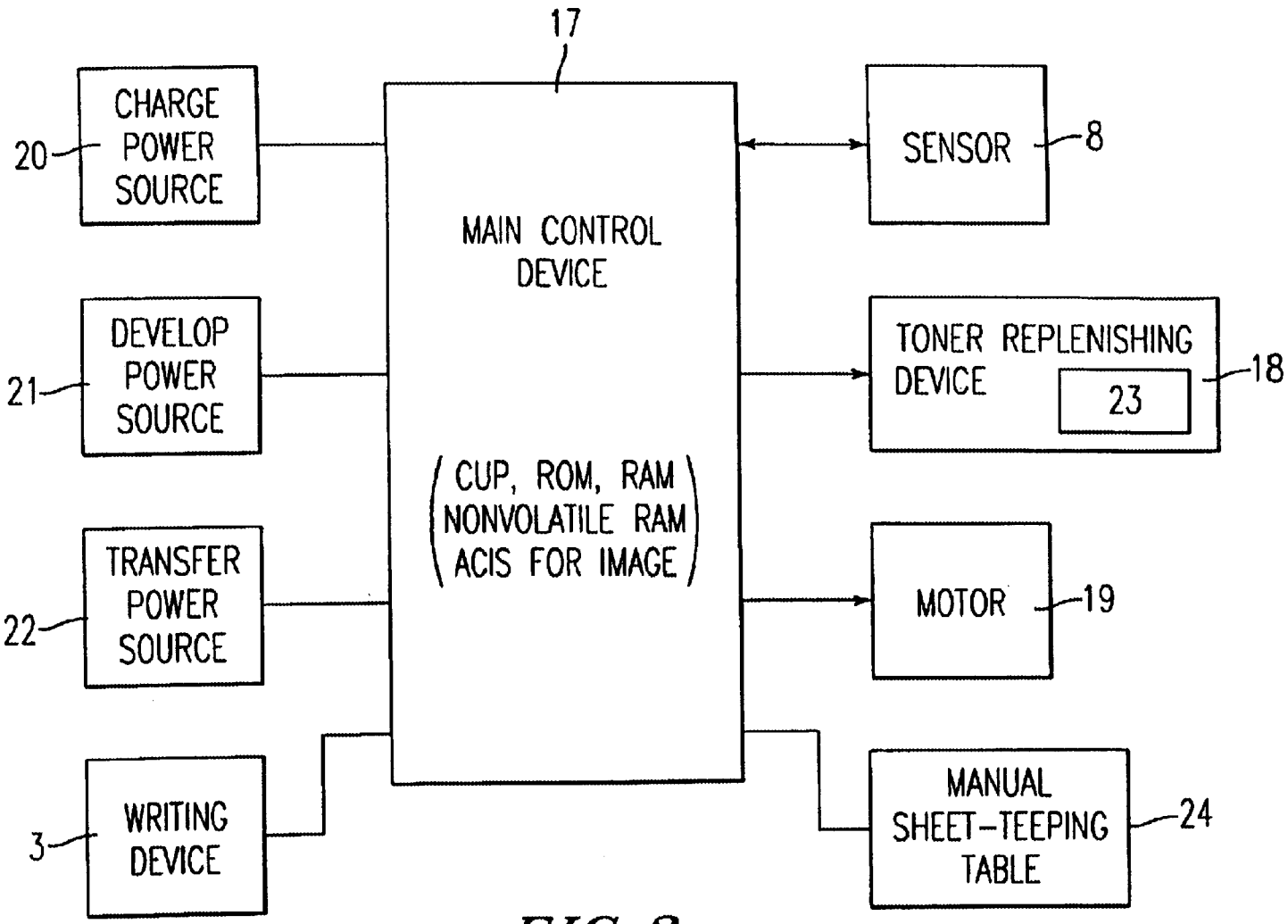
FIG. 3 is a block diagram schematically showing a control system.

Referring to FIG. 3, the control device 17 sends two write signal to the writing device 3 of FIG. 1. The first signal represents a toner pattern, and the second signal represents a toner image. A high-voltage charge power source 20, a high-voltage developing power source 21 and a high-voltage transfer power source 22 apply a preselected voltage of a particular polarity to each of (1) the charge roller 2, (2) the developing roller 4*b* and (3) the transfer roller 5, based on a signal output from the control device 17. A drive motor 19 rotates and drives (1) the drum 1, (2) the developing roller 4*b*, and (3) the transfer roller 5. A toner replenishing device 18 (having a motor 23) is controlled under the control of the control device 17.

In the illustrative embodiment, the toner pattern is formed in the area on the drum 1 before the toner image in order to obtain correct toner density control. When the toner pattern and the transfer sheet P are detected close together in time, both detections require precision timing. However, the difference between the quantity of reflected light for the toner pattern and for the transfer sheet P is detectable by the optical sensor 8. Thus, the sensing control system is capable of accurately recognizing a change in a detected object by using the difference of an output characteristic representative of the quantity of reflected light.

FIG. 4 shows a specific configuration of output characteristics (output voltages) for the optical sensor 8. The sensor 8 outputs a reference voltage Vsg (e.g., 4.0 V) representing the background (when toner is absent and assuming nearly ideal conditions on the drum 1). Nearly ideal conditions correspond to conditions a new photoconductive element (e.g., amount of charged held by a new photoconductive element of). The nearly "ideal" conditions vary over time as a photoconductive element ages. The effects of the aging process, however, can be compensated for by a gain circuit or software that modifies a sensed charge according to an age (measured by time or number/type of images formed) of the photoconductive element. Likewise, the sensor 8 outputs a reference voltage corresponding to an amount of reflected light reflected from the transfer sheet. The reference voltage Vp (e.g., 3.0 V) corresponds to a maximum amount of reflected light from the transfer sheet (under non-ideal conditions). The sensor outputs a reference voltage Vs1 (e.g., 0.5 V) when a toner pattern is detected when the toner content of the developer D is nearly ideal.

Each of the predetermined output voltages (i.e. the reference voltages corresponding to (1) the toner pattern, (2) the background and (3) the transfer sheet P) is stored in a non-volatile memory device (e.g., a Read Only Memory (ROM) or a Flash Memory) forming a portion of the control device 17 (see FIG. 3). The control device 17 compares the output voltages in memory and the voltage which is output by the optical sensor 8 after the image forming apparatus 100 starts an operation. Based on the comparison, the control device 17 determines the kind of detected object and controls the density of the toner image while forming a visible image and transporting the transfer sheet P.

As stated above, in the illustrative embodiment, the sensing control system is provided with the optical sensor 8 and the control device 17, and the detected object is recognized by measuring voltages corresponding to an amount of reflected light. Thus, sufficiently precise detection is obtained using only one optical sensor. However, variations in timing and voltages are supported in an alternate embodiment. In an embodiment which more than one photoconductive element is used, the non-volatile memory stores element specific voltage characteristics. In an embodiment in which various transfer sheet types cause charges in detected voltages, the non-volatile memory stores timing information and voltages specific to the type of transfer sheet being used. Moreover, in an embodiment in which more than one toner pattern is used, the non-volatile memory stores pattern-specific timing and voltage information.

Figure 5:
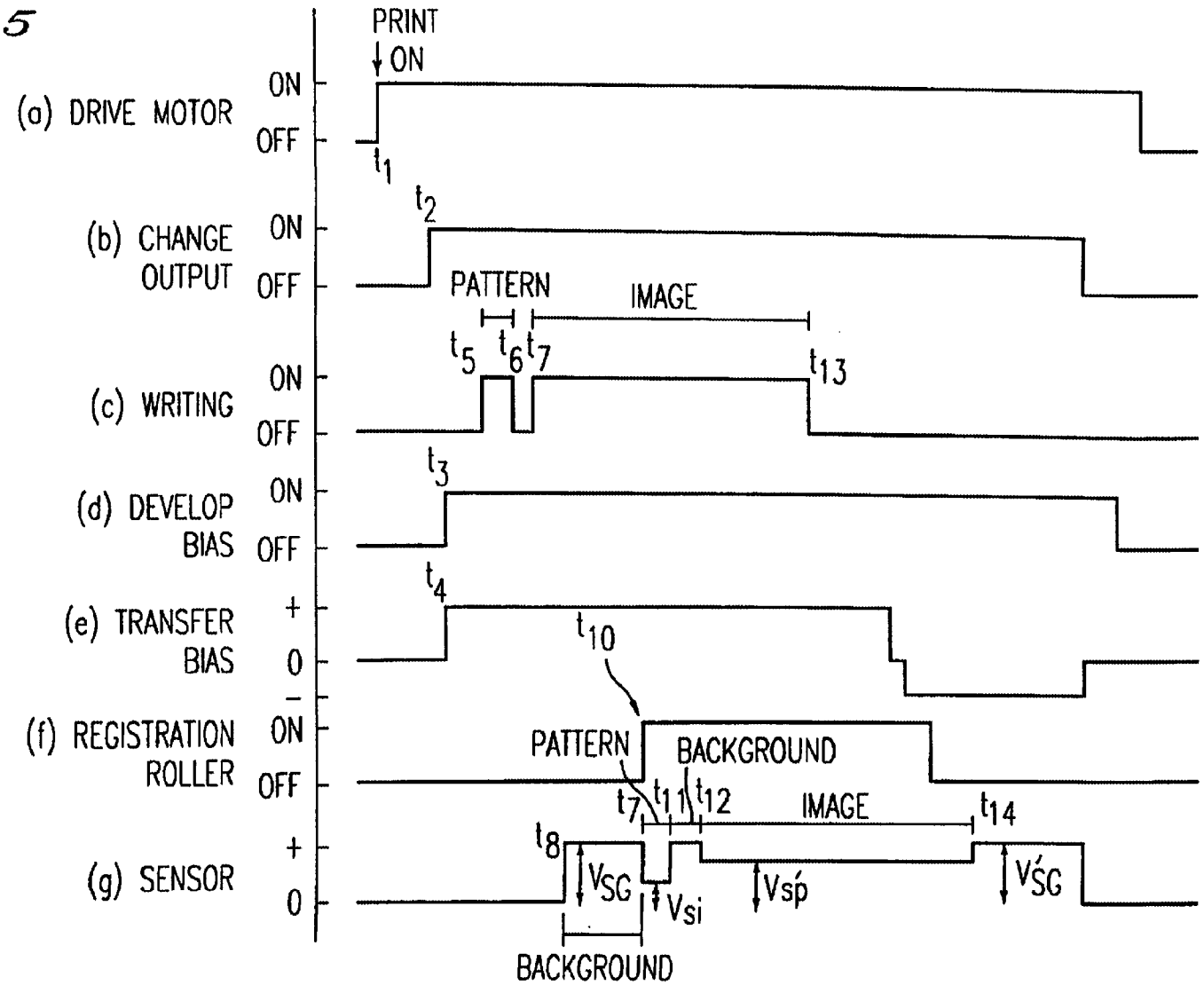
FIG. 5 is a timing diagram demonstrating a specific operation of the illustrative embodiment.
Figure 6A:
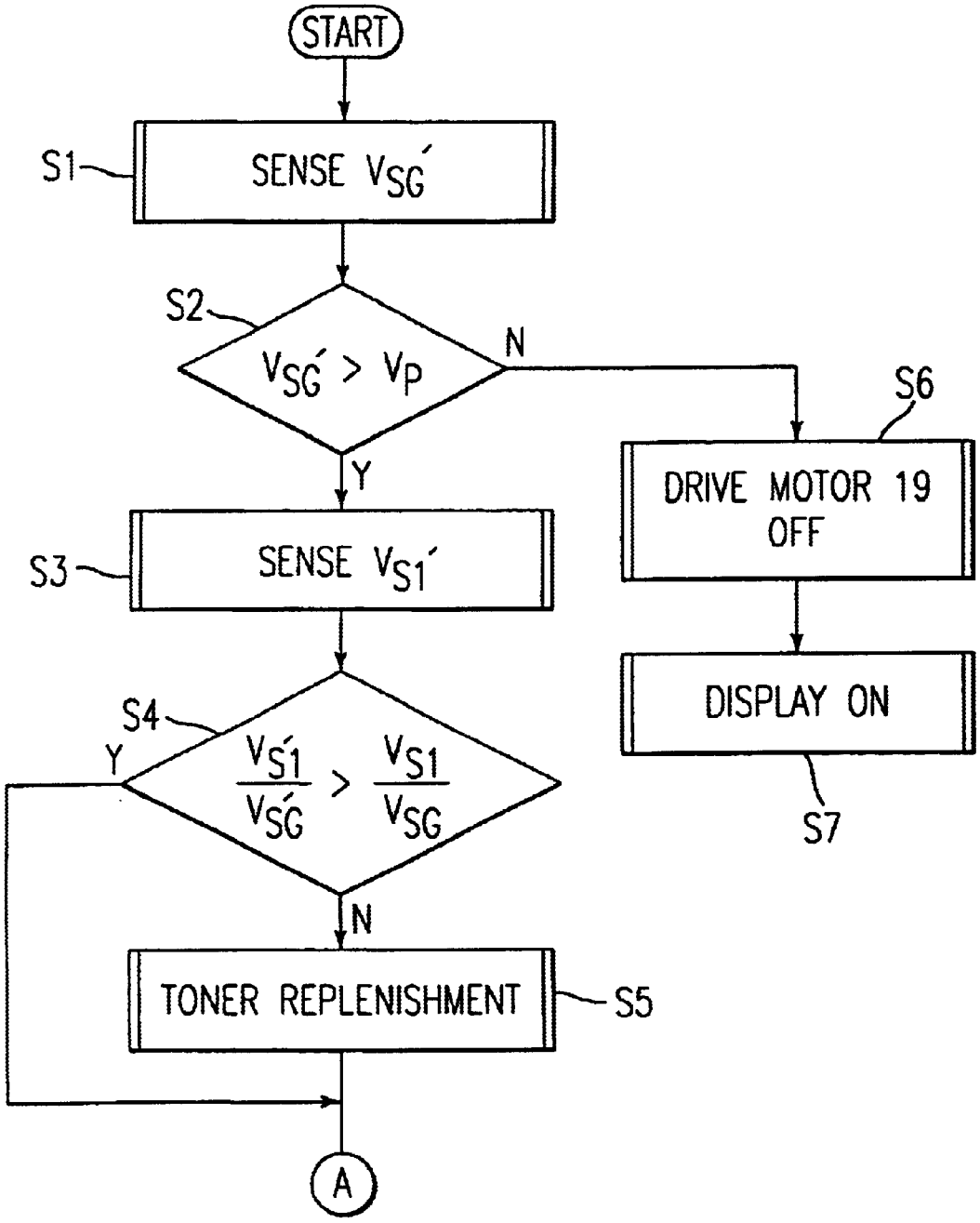
FIGS. 6A and 6B are flowcharts corresponding to FIG. 2.
Figure 6B:
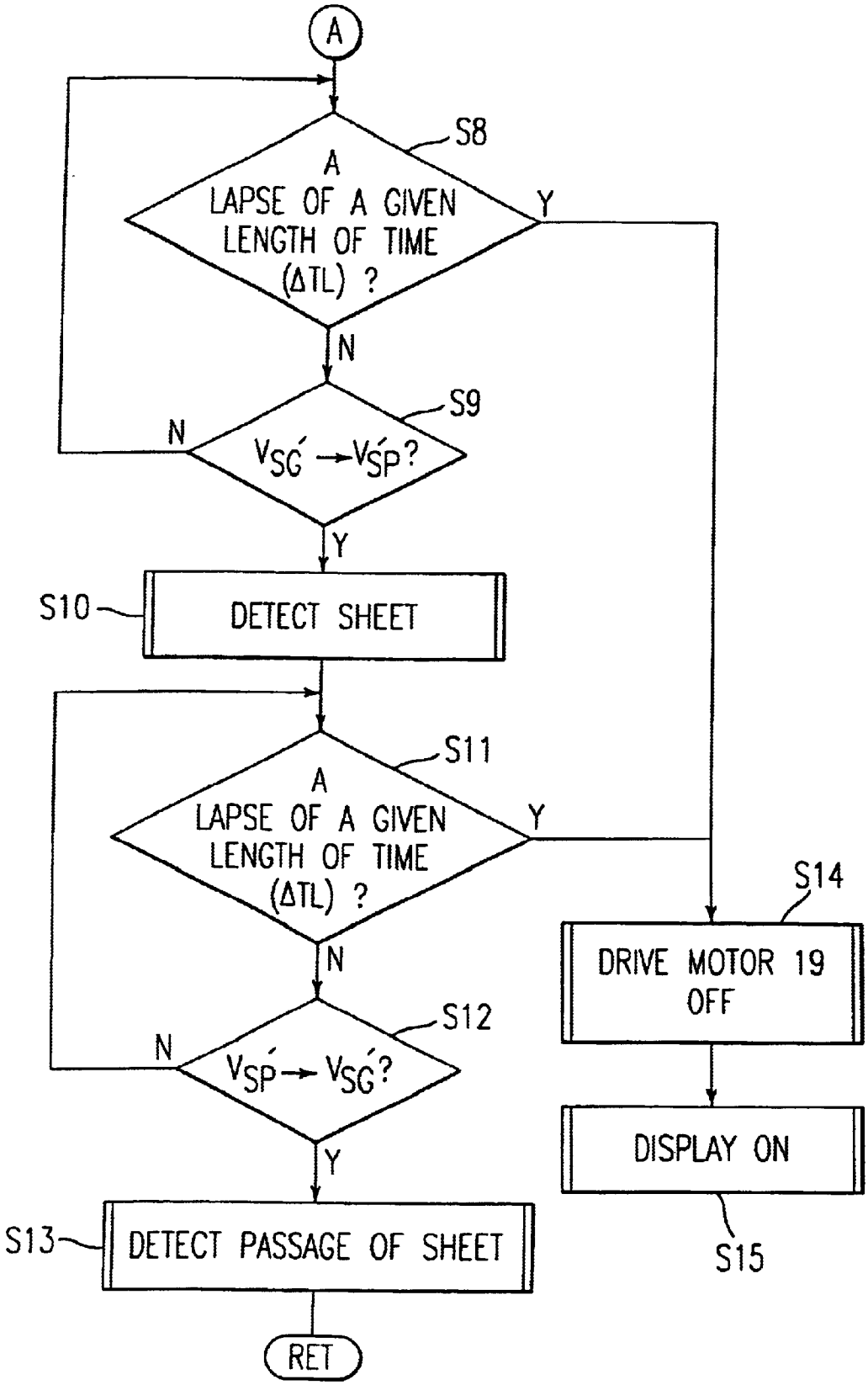

FIG. 5 shows a specific procedure in which a toner pattern is formed and then a transfer sheet is fed in order to form a toner image on the transfer sheet after the toner pattern. FIG. 6A shows a specific procedure for sensing a density of a toner pattern associated With the procedure of FIG. 5. FIG. 6B shows a specific procedure of determining the presence or absence of the transfer sheet P associated with the procedure of FIG. 5.

As shown in FIG. 5, at time $t_1$, when a print request is initiated tat the point labeled "Print On."), the drum 1 starts rotating in synchronism with the rotation of the drive motor 19. When the drum 1 reaches a constant speed at $t_2$, a negative voltage is applied to the charge roller 2 to charge the drum 1 to a negative polarity. The writing device 3 forms a latent image as a particular image representative of a pattern image on the charged surface of the drum 1.

When the charged area of the drum 1 arrives at the developing device 4, a negative bias voltage is applied to the developing roller 4*b* at time $t_3$ in order to enable development of a pattern image. A transfer bias is applied at substantially the same time as the bias on the developing roller. The development toner pattern is of sufficient size to be detected but not too large as to (1) significantly delay formation of the toner image or (2) consume excessive amounts of toner. In the preferred embodiment, the pattern is a square or rectangular pattern between 16 and 24-mm square, and is preferably a 20-mm square, rectangular pattern.

At time $t_8$, the optical sensor 8 is turned on and senses the reflection density of the portion of the drum 1 charged by the bias voltage, but which was not scanned by the laser beam L. This portion of the drum 1 corresponds to the background before the toner pattern is brought to the optical sensor 8. Between $t_8$ and $t_9$, the optical sensor 8 outputs a voltage Vsg' representative of the background.

As shown in FIG. 6A, step S1 corresponds to sensing the output voltage Vsg' (step S1, FIG. 6A). In step S2, the output voltage Vsg' of the optical sensor 8 is compared to the reference voltage Vp via the control device 17. If the output voltage Vsg' is lower than the reference voltage Vp, the control device 17 determines that the drum 1 has deteriorated too much to properly form an image, and, consequently, in steps S6 and S7, respectively, the drive motor 19 is switched off and a display reports the abnormal state. Using the comparison of step S2 of FIG. 6A, the present invention can (1) discriminate between the background and the transfer sheet P and (2) detect deterioration of the drum 1.

Returning to FIG. 5, after further rotation of the drum, the sensor 8 senses the presence of the toner pattern at t*9*. That is, after sensing the background, the optical sensor 8 continues sensing the amount of reflection from the surface of the drum 1 and outputs a voltage Vs1' between $t_9$ and $t_{11}$ (corresponding to step S3 in FIG. 6A). Thus, the detected output voltage of the sensor 8 changes from Vsg' to Vs1' when the drum rotates from the background to the toner pattern.

The control device 17 receives the output voltages Vsg' and Vs1' from the optical sensor 8. The CPU of the control device 17 calculates a ratio of the voltage Vs1' of the toner pattern to the voltage Vsg' of the background, and checks if the ratio is within a target range for the nearly ideal conditions used to calculate Vs1' and Vsg'. If the ratio is not within the target range, in step S5 the control device 17 causes the toner replenishing device 18 to replenish toner in the developing device 4.

After the toner pattern is formed from $t_5$ to $t_6$, a latent image representative of a toner image is formed on the drum 1 from $t_7$ to $t_6$, by the writing device 3. However, another background section remains on the drum between $t_6$ and $t_7$. The image is developed by the developing device 4. The transfer sheet P sent out from the cassette 6*a* is conveyed to the registration position R by the conveying roller 6*c*. At time $t_{10}$, the transfer sheet is transferred to the transfer area by the pair of registration rollers 9 in synchronism with the scan of the writing device 3.

After the commencement of the operation of the pair of registration rollers 9, the control device 17 determines if the transfer sheet is detected by the optical sensor 8 within a given length of time ΔTL. If the optical sensor 8 does not detect the sheet within time ΔTL, the system determines that a jam has occurred and, in steps 14 and 15, respectively, the drive motor 19 is switched off and the display (not shown) indicates the abnormal state.

To detect the presence of the transfer sheet during the time ΔTL, the control device 17 determines if the output of the sensor 8 changes from Vsg' (corresponding to the background section formed between $t_6$ and $t_7$) to Vsp' within the time ΔTL. The loop from steps S8 and S9 of FIG. 6B represents this checking process. If this change in voltage is detected, the transfer sheet P is detected (step S10). By tracking a change in the output voltage of the sensor 8 in steps S8–S10, the transfer sheet P can be accurately detected and the background and the transfer sheet P can be distinguished.

Just as the control device 17 tracks paper movement in steps S8–S10, it also tracks paper movement in steps S11–S13. The control device 17 determines when or if the optical sensor 8 detects that the transfer sheet has finished passing between the drum 1 and the roller 5. If the transfer sheet does not finish passing in a time ΔTE, after the transfer sheet was detected by the optical sensor 8, then a jam has occurred. As a results, in steps S14 and S15, respectively, the drive motor 19 is switched off and the display (not shown) reports the abnormal state.

To determine if the transfer sheet P finishes passing through in the allotted time, the output of the optical sensor 8 is monitored to see if the voltage returns to Vsg' from Vsp' within the allotted time. If the voltage transitions from Vsp' to Vsg', then the transfer sheet has been properly transported. Thus, by sensing a change in the output voltage of the sensor 8 in steps S11–S13, the passage of the transfer sheet P can be accurately detected while still precisely discriminating between the background and the transfer sheet P.

The present invention also addresses detection under sub-optimal conditions. For example, a surface of the optical sensor 8 may become soiled with scattered toner or paper dust, due to a transfer electric field. Thus, without compensation the toner density and the sheet P may be improperly detected by the optical sensor.

Figure 7:
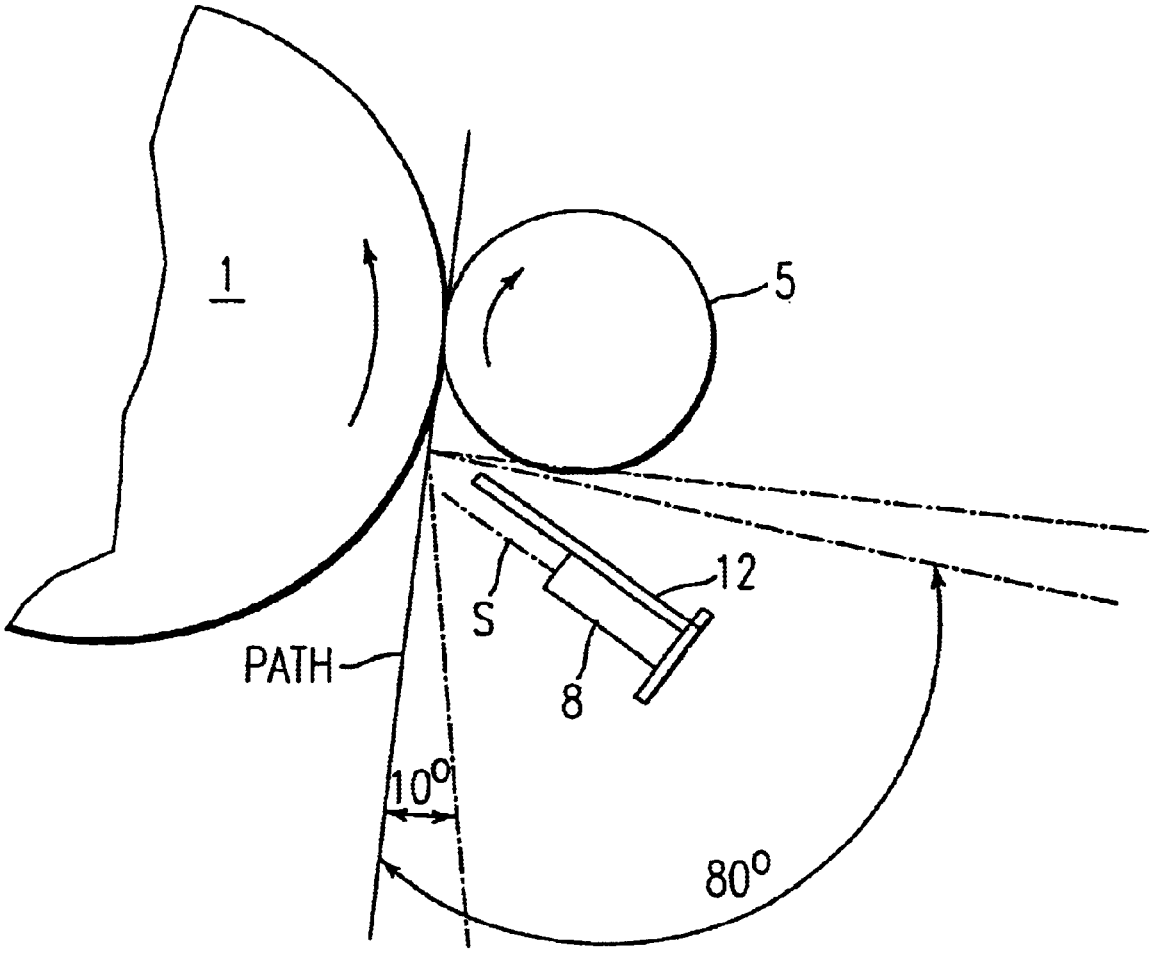
FIG. 7 is an enlargement of a portion of the optical sensing section shown in FIG. 1.

To address this problem, as shown in FIGS. 1 and 7, a blocking member 12, in the shape of a sheet, is disposed between the transfer roller 5 and the optical sensor 8. The blocking member 12 is preferably made of an insulating material, for example, an elastic resin or rubber. A leading edge of the blocking member 12 reaches a position adjacent to the transfer area. As a result, an influence of the transfer electric field in the direction of the optical sensor 8 is blocked due to an electric non-conductance of the blocking member 12. Thus, the sensor surface of the sensor 8 is not soiled with the scattered toner or paper dust, and the toner density and the transfer sheet can be more stably detected.

As shown in greater detail in FIG. 7, the blocking member 12 runs parallel to an optical path S and is arranged to avoid obstructing the optical path S of the projected light and the reflected light. Thus, the change in the quantity of reflected light is more accurately detected.

Further, it is desirable that the blocking member 12 is arranged with an inclination to the conveying path of the transfer sheet P in the range of 10 to 80 degrees. With the above-mentioned construction, even if a leading edge of the transfer sheet P touches the blocking member 12 before reaching the transfer area, the transfer sheet P nonetheless will travel along the blocking member 12. Thus, the transfer sheet P is guided smoothly to the transfer area and is further conveyed smoothly over the blocking member 12. Consequently, an occurrence of jamming of the transfer sheet P is reduced.

According to another aspect of the invention, when the control device 17 assumes that a jam has occurred before the transfer sheet P arrives at the optical sensor 8, the drive motor 19 is switched off. However, without the paper to separate them, the toner already on the drum 1 will dirty the roller 5. Unfortunately, due to the moment of inertia usually the drum 1 will have continued rotating after the drive motor 19 is switched off. This problem is exacerbated when the surface layer of the transfer roller 5*b* is implemented by a foam material because the toner in the dents of the foam is apt to deposit on the rear of the transfer sheet P being conveyed between the roller 5 and the drum 1.

Returning to the illustrative embodiment of FIG. 3, the transfer power source 22 (which is controlled by the control device 17) applies a voltage of the same polarity as the toner to the shaft 5*a* of the transfer roller 5 when the transfer sheet P remains undetected by the optical sensor 8 after the lapse of the given length of time ΔTL. In short, when the transfer sheet P is detected by the optical sensor 8 within the given length of time ΔTL, the transfer power source 22 applies to the transfer roller 5 a voltage of a polarity opposite to the polarity of the toner. On the other hand, when a jam occurs, the power source 22 applies to the roller 5 a voltage of the same polarity as the toner. By applying similar polarity voltages to the toner and the transfer roller 5, an electric field is formed that prevents the toner from being transferred from the drum 1 to the transfer roller 5. As a result, less toner is deposited on the roller 5.

Furthermore, it is difficult to detect accurately a transfer sheet made of transparent material using by the optical sensor 8 because there is little change in the quantity of reflected light between the transparent transfer sheet and the drum 1. One such transparent sheet is an Over Head Projector (OHP) sheet. Generally, a special transfer sheet such as the transparent transfer sheet is sent out from a manual sheet-feeding table 24 (see FIG. 1). Accordingly, the control device 17 interrupts the operation of transfer sheet detection when the manual sheet-feeding table 24 is opened. Consequently, an error is not erroneously reported by the sensor 8. To provide this capability, a sensor, not shown, is mounted on the manual sheet-feeding table 24 to detect the special transfer sheet.

The above-mentioned illustrative embodiment has been explained with values of output characteristics, a structure, and an arrangement of the sensor 8 (i.e. position and angle of the sensor). These, however, are not intended to be limiting and may be altered to match other image forming conditions. The optical sensing systems have been shown and described as being used with an image forming apparatus that transfers a toner image from the drum 1 to sheet P. However, the embodiment is similarly applicable to any kind of image forming apparatus. For example, in an image forming apparatus having an intermediate image transfer element between a photoconductive element and a paper, the invention utilizes an optical sensor for detecting a nearby transfer position for paper where a toner image is transferred from the intermediate image transfer element to a sheet of paper. Also, horizontal, vertical and diagonal paper transports are all encompassed by the present invention.

The present application claims priority to Japanese application numbers (1) 10-36725, filed Feb. 2, 1998 and (2) Japanese application having Japanese attorney docket number JP98-68112, filed Dec. 8, 1998. The contents of those applications are incorporated herein by reference in their entirety.

What is claimed is:

1. A computer program product comprising:

a computer readable medium and a computer program code mechanism embedded in the computer storage medium for causing a processor control an image forming device subsystem, the computer program code mechanism comprising:

a first computer code device configured to read a first charge value from a sensor as the sensor senses a photoconductive element having a background condition at a first time:

a second computer code device configured to drive a transfer sheet at a second time:

a third computer code device configured to read a second charge value from the sensor as the sensor senses a toner pattern on the photoconductive element at a third time; and a fourth computer code device configured to detect a paper jam based on relative timings of the first, second and third times.

2. The computer program product as claimed in claim 1, further comprising:

a fifth computer code device configured to read a third charge value from the sensor as the sensor senses a toner image on the transfer sheet at a fourth time, wherein the first computer code device further comprises a sixth computer code device configured to read a fourth charge value from the sensor as the sensor senses the photoconductive element having the background condition at a fifth time, and wherein the fourth computer code device further comprises a seventh computer code device configured to detect a paper jam based on relative timings of the second and fifth times.

3. The computer program product as claimed in claim 1, further comprising a fifth computer code device configured to compensate for aging of the photoconductive element by modifying the second charge value.

* * * * *

UNITED STATES PATENT AND TRADEMARK OFFICE

CERTIFICATE OF CORRECTION

PATENT NO. : 6,628,903 B1
DATED : September 30, 2003
INVENTOR(S) : Ohori et al.

It is certified that error appears in the above-identified patent and that said Letters Patent is hereby corrected as shown below:

Title page,
Item [30], Foreign Application Priority Data, should read
-- [30] Foreign Application Priority Data
Feb. 2, 1998 (JP) …….. 10-036725
Dec. 8, 1998 (JP) …….. 10-368558 --

Signed and Sealed this

Thirteenth Day of January, 2004

JON W. DUDAS
*Acting Director of the United States Patent and Trademark Office*